US008764044B2

(12) United States Patent
Bergendahl et al.

(10) Patent No.: US 8,764,044 B2
(45) Date of Patent: Jul. 1, 2014

(54) GLIDING BOARD WITH MODIFIED BENDING CHARACTERISTICS AND EDGE FEATURES ADJACENT BINDING MOUNTING REGIONS

(75) Inventors: Peter J. Bergendahl, South Burlington, VT (US); Jeffrey Thomas Burga, Williston, VT (US); Richard William Wagner, Waterbury, VT (US); Scott Seward, South Burlington, VT (US); Christopher Fidler, Burlington, VT (US)

(73) Assignee: The Burton Corporation, Burlington, VT (US)

( * ) Notice: Subject to any disclaimer, the term of this patent is extended or adjusted under 35 U.S.C. 154(b) by 276 days.

(21) Appl. No.: 13/307,486

(22) Filed: Nov. 30, 2011

(65) Prior Publication Data

US 2012/0235369 A1 Sep. 20, 2012

Related U.S. Application Data

(63) Continuation-in-part of application No. 12/887,621, filed on Sep. 22, 2010, now Pat. No. 8,517,409.

(60) Provisional application No. 61/246,081, filed on Sep. 25, 2009.

(51) Int. Cl.

| | |
|---|---|
| ***A63C 5/00*** | (2006.01) |
| ***A63C 5/04*** | (2006.01) |
| *A63C 5/048* | (2006.01) |
| *A63C 5/052* | (2006.01) |

(52) U.S. Cl.

CPC ..... *A63C 5/003* (2013.01); *A63C 5/0405* (2013.01); *A63C 5/0434* (2013.01); *A63C 5/048* (2013.01); *A63C 5/052* (2013.01); *A63C 5/006* (2013.01)

USPC ..... 280/609; 280/14.22

(58) Field of Classification Search

CPC ..... A63C 5/00; A63C 5/003; A63C 5/006; A63C 5/0405; A63C 5/0434; A63C 5/052

USPC ..... 280/601, 602, 608, 609, 610, 14.21, 280/14.22

See application file for complete search history.

(56) References Cited

U.S. PATENT DOCUMENTS 4,974,868 A * 12/1990 Morris ..... 280/609
6,352,268 B1 * 3/2002 Peart ..... 280/14.21

(Continued)

FOREIGN PATENT DOCUMENTS

WO WO 00/40310 A1 7/2000
WO WO 2006/044233 A2 4/2006
WO WO 2010/072819 A1 7/2010

OTHER PUBLICATIONS

Invitation to Pay Additional Fees from the International Searching Authority for International Application No. PCT/US2012/066617, Mailed Nov. 27, 2012.

*Primary Examiner* — Katy M Ebner

(74) *Attorney, Agent, or Firm* — Wolf, Greenfield & Sacks, P.C.

(57) ABSTRACT

A gliding board may have less resistance to bending in portions within one or both binding mounting regions as compared to portions at or near ends of the binding mounting regions. Some embodiments provide for increased ability to store and release energy when performing certain maneuvers with the board, such as nose presses, ollies and similar moves. Regions of greatest stiffness may be arranged at outer ends of the binding mounting regions, and may be arranged along lines that are transverse to a longitudinal axis of the board. Alternately, a board may include heel and toe convex portions in the heel and toe side edges that are offset along the board length, e.g., so that the heel convex portions are closer to each other and to a longitudinal board center than the toe convex portions.

37 Claims, 4 Drawing Sheets

(56) References Cited

U.S. PATENT DOCUMENTS

| | | | | |
|---|---|---|---|---|
| 6,394,483 | B2 * | 5/2002 | Stubblefield | 280/602 |
| 6,499,758 | B1 * | 12/2002 | Fournier | 280/609 |
| 7,396,036 | B2 * | 7/2008 | Barbieri et al. | 280/601 |
| 7,798,514 | B2 * | 9/2010 | Canaday et al. | 280/609 |
| 7,823,892 | B2 * | 11/2010 | Olson et al. | 280/14.22 |
| 7,837,217 | B2 * | 11/2010 | Avgustin et al. | 280/602 |
| 2003/0098557 | A1 * | 5/2003 | Barbieri et al. | 280/14.21 |
| 2004/0084878 | A1 * | 5/2004 | Adamczewski | 280/602 |
| 2006/0091645 | A1 * | 5/2006 | Cobb et al. | 280/609 |
| 2007/0170694 | A1 * | 7/2007 | Adamczewski et al. | 280/607 |

* cited by examiner

GLIDING BOARD WITH MODIFIED BENDING CHARACTERISTICS AND EDGE FEATURES ADJACENT BINDING MOUNTING REGIONS

This application is a continuation in part of U.S. application Ser. No. 12/887,621, filed Sep. 22, 2010, which claims priority to U.S. Provisional Application No. 61/246,081, filed Sep. 25, 2009.

BACKGROUND

This invention relates to a gliding board, such as a snowboard, wakeboard, or other similar device for gliding on a surface.

Snowboards having areas with different bending characteristics along the length of the board are generally known, e.g., from U.S. Pat. No. 6,499,758; U.S. Patent Publication 2004/0084878 and U.S. Patent Publication 2007/0170694. These board designs tend to stiffen the board in areas under the rider's feet as compared to adjacent areas fore and aft of the binding mounting region. For example, as can be seen in FIGS. 1 and 4 of U.S. Patent Publication 2004/0084878 and FIGS. 1 and 4 of U.S. Patent Publication 2007/0170694, the thickness of the board is greater in the binding mounting regions (reference numbers 10 and 12 for U.S. Patent Publication 2004/0084878, and reference numbers 16 and 18 U.S. Patent Publication 2007/0170694). Similarly, U.S. Pat. No. 6,499,758 has increased structural strength in the board at areas under the rider's feet. See col. 5, lines 51-57 and FIGS. 1 and 16, for example.

Regarding with convex protrusions at the side edges, references such as WO10/072,819 and U.S. Pat. No. 6,758,487 show a board with protrusions located at various places on the side edges.

SUMMARY OF INVENTION

In accordance with at least some embodiments of the invention, the inventors have unexpectedly found that arranging a board to more easily bend in portions within one or both binding mounting regions as compared to portions at or near at least one end of the binding mounting regions provides increased ability for the board to store and release energy when performing certain maneuvers, such as nose presses, ollies and similar moves. In one embodiment, the board may be arranged to bend more easily within a binding mounting region as compared to at least a portion of the board between the binding mounting region and the nose or tail of the board. For example, the board may include forward and rear binding mounting regions with the forward binding mounting region being located nearer a nose of the board than the rear binding mounting region. A portion of the board between the forward binding mounting region and the nose may be arranged to be stiffer, and thus more difficult to bend, than a portion of the board within the forward binding mounting region, as well as be stiffer than a portion between the forward and rear binding mounting regions. As a result, if the rider performs a nose press or similar move that tends to put a bending force on the board (such that the board bends about an axis transverse to a longitudinal axis of the board and generally parallel to the board top surface), the board will tend to bend more (e.g., along a longer arc and/or with a smaller radius of curvature) in portions under the rider's front foot and/or between the front foot and the tail as compared to portions of the board between the front foot and the nose. The board may be similarly configured near the rear binding mounting region, e.g., so a portion of the board between the rear binding mounting region and the tail may be arranged to be stiffer, and thus more difficult to bend, than a portion of the board within the rear binding mounting region. This type of arrangement is in contrast to boards that have thicker or otherwise increased structural strength under the rider's feet. Increased strength under the rider's feet tends to move areas of increased board flex away from the feet, reducing the rider's ability to store useful energy in the board for nose presses, ollies and similar moves.

In one embodiment, a board may be made to have a greater thickness in portions of the board between the forward binding mounting zone and the nose and/or between the rear binding mounting zone and the tail as compared to portions within the binding mounting zones. This is in contrast to typical board arrangements where a thickness of the board at the binding mounting regions is equal to or more than a thickness of the board between each binding mounting region and the nose or tail, respectively. In one embodiment, the thickness variations may be achieved by adjusting the thickness of a core of the board (e.g., the thickness of the core, which may be made of wood, foam or other, may be made less in the binding mounting regions than at other areas adjacent the binding mounting regions). This arrangement of the core thickness may be useful for boards that are made with a so-called sidewall construction, where the board side edges include a sidewall element positioned between top and bottom reinforcement layers and at least partially exposed along the board's edge. In another embodiment, the board may have a cap construction at the nose, tail and running length and the thickness of the board may be defined, at least in part, by the spacing between mold elements used to form the board during a molding process.

In another embodiment, a board may be arranged to increase the board's resistance to bending in particular areas, such as in regions between the binding mounting regions and the nose or tail. For example, the board may have internal members, such as reinforcement elements, that tend to stiffen the board in desired areas. In one embodiment, a core of the board may have an increased or decreased moment of inertia in particular locations such that the board has desired bending characteristics at the binding mounting regions in comparison to adjacent areas in the running length. In one embodiment, the core which is otherwise made of laminated wood strips, may include metal or other material in certain regions.

In another aspect of the invention, a board may have a concave portion in the top surface located at both the forward and rear binding mounting regions, i.e., a single concave portion may span from the forward binding mounting region to the rear binding mounting region. In other arrangements, two separate concave portions may be located at respective front and rear binding mounting regions. Convex portions may be located in the top surface forward of the forward mounting region and rearward of the rear mounting region. In another embodiment, one or more concave portions may be located in the bottom surface of the board under the binding mounting regions so as to give desired bending characteristics to the board. As described in detail below, a variety of options are available to provide a board with bending characteristics in accordance with aspects of the invention.

In one illustrative embodiment, a gliding board, such as a snowboard, includes an upturned nose at a forward end of the board, a tail at a rear end of the board, a running length connected to and located between the nose and tail, a top surface of the board extending from the nose to the tail over a top portion of the running length, a bottom surface of the board extending from the nose to the tail over a lower portion of the running length, at least a portion of the bottom surface being constructed and arranged to contact a gliding surface during riding, and side edges on opposite sides of the running length and extending between the nose and the tail. Forward and rear binding mounting features may each be arranged to engage with and secure a foot binding to the board top surface with the forward and rear binding mounting features each defining a respective forward and rear binding mounting region in the running length in which a respective foot binding is securable to the board. The binding mounting features may include, for example, one or more threaded inserts secured to the board, one or more channels secured to the board, or other arrangements. The forward binding mounting region may be located nearer the nose than the rear binding mounting region, and the forward binding mounting region may have an outer or forward end nearest the nose and the rear binding mounting region may have an outer or rear end nearest the tail.

The board may also have outer forward and rear regions of highest or otherwise increased stiffness with respect to bending of the board about an axis that is transverse to a longitudinal axis of the board (and that is generally parallel to a top surface of the board) in a portion between the forward binding mounting region and the nose, and in a portion between the rear binding mounting region and the tail, respectively. The outer forward and rear regions of increased stiffness may be arranged respectively along outer forward and rear lines that are transverse to the longitudinal axis. For example, the board may have regions of greatest thickness that are located forward of the forward binding mounting region and rearward of the rear binding mounting region and that are arranged along lines that are at an angle of between about 90-120 degrees to the longitudinal axis, e.g., about 100-110 degrees. Thus, in some embodiments, the regions of highest stiffness may be oriented so as to be generally parallel with a nearest rider's foot that is secured to the board. By arranging the regions of highest stiffness to be generally parallel to the nearest rider's foot, the board's ability to store energy or otherwise perform maneuvers such as ollies may be enhanced. In some embodiments, the toe side ends of the outer forward and rear lines may be located further from a longitudinal center of the board than heel side ends of the outer forward and rear lines. Thus, the arrangement of the regions of highest or otherwise increased stiffness may mirror that of the rider's standard foot position, in which the toes are generally located nearer the board ends, and the heels are located nearer the board's longitudinal center. This arrangement may give the rider a sense of more even force transfer along the lateral side of the feet, e.g., because the board may resist bending in a generally equal fashion from the rider's heel to the toe on the lateral side of the foot.

In another embodiment, the board may also have inner forward and rear regions of increased stiffness with respect to bending of the board about an axis that is transverse to the longitudinal axis that are arranged along inner forward and rear lines between the binding mounting regions. The inner forward region of increased stiffness may be located nearer the forward binding mounting region than the inner rear region of increased stiffness, and the inner rear region of increased stiffness may be located nearer the rear binding mounting region than the inner forward region of increased stiffness. Both the inner forward and rear regions of increased stiffness may have a greater stiffness with respect to bending than portions of the board within the binding mounting regions. Thus, the forward and rear binding mounting regions may be flanked by regions of increased stiffness, which may cause the board to tend to bend more and/or with a smaller radius of curvature under the rider's foot as compared to portions of the board that are forward and rear of the foot. In one arrangement, the inner forward line may be parallel to the outer forward line, and the inner rear line may be parallel to the outer rear line. Thus, the outer and inner forward lines may be generally parallel to the rider's forward foot, and the outer and inner rear lines may be generally parallel to the rider's rear foot. The inner forward and rear regions of increased stiffness may have the same, or a lower resistance to bending than the outer forward and rear regions of highest stiffness, and the regions of highest or otherwise increased stiffness may be formed by thickness variations in a core of the board.

In another aspect of the invention, a gliding board may include an upturned nose at a forward end of the board, a tail at a rear end of the board, a running length connected to and located between the nose and tail, a top surface of the board extending from the nose to the tail over a top portion of the running length, a bottom surface of the board extending from the nose to the tail over a lower portion of the running length, at least a portion of the bottom surface being constructed and arranged to contact a gliding surface during riding, and heel side and toe side edges on opposite sides of the running length and extending between the nose and the tail. Forward and rear binding mounting features may each be arranged to engage with and secure a foot binding to the board top surface, with the forward and rear binding mounting features each defining a respective forward and rear binding mounting region in the running length in which a respective foot binding is securable to the board. The forward binding mounting region may be located nearer the nose than the rear binding mounting region, the forward binding mounting region may have a forward end nearest the nose, and the rear binding mounting region may have a rear end nearest the tail. The heel side edge may include forward and rear heel convex portions respectively positioned near a location of a forward and rear heel of a rider's feet when secured to the board at the forward and rear binding mounting regions, and the toe side edge may include forward and rear toe convex portions respectively positioned near a location of a forward and rear toe of a rider's feet when secured to the board at the forward and rear binding mounting regions. In one embodiment, the forward heel convex portion is located closer to a longitudinal center of the board than the forward toe convex portion, and the rear heel convex portion is located closer to a longitudinal center of the board than the rear toe convex portion. For example, the heel and toe convex portions may be located relatively near the heel and toe of a rider's nearest foot when the feet are arranged at a typical stance angle such that the rider's toes are located nearer the board ends than the heels. This may enable the convex portions to give the rider a greater sense of responsiveness, such as when turning, particularly on a hard surface.

In one arrangement, a forward edge effect line that extends between the forward heel convex portion and the forward toe convex portion is transverse to a longitudinal axis of the board, and a rear edge effect line that extends between the rear heel convex portion and the rear toe convex portion is transverse to the longitudinal axis. For example, the forward and rear edge effect lines may be arranged at an angle of between about 90-120 degrees to the longitudinal axis, and may be generally parallel to a rider's forward and rear feet, respectively, when mounted to the board. The forward edge effect line may be located near an inner end of the forward mounting region, and the rear edge effect line may be located near an inner end of the rear mounting region, e.g., so that the heel and toe convex portions are located closer to the board's longitudinal center than the rider's nearest heel and toe, respectively. The heel and toe convex portions may each have a peak height relative to an adjacent portion of the side edge of about 0.5 to 2.5 mm. For example, the side edges may have a sidecut arrangement with the convex portions extending outwardly from the sidecut to form protrusions.

In some embodiments, the heel and toe convex portions may be combined with regions of increased stiffness discussed above. Thus, for example, a board having heel and toe side convex portions may also have outer forward and rear regions of highest or increased stiffness with respect to bending of the board about an axis that is transverse to a longitudinal axis of the board in a portion between the forward binding mounting region and the nose and in a portion between the rear binding mounting region and the tail, respectively. The outer forward and rear regions of highest or increased stiffness may be arranged respectively along outer forward and rear lines that are transverse to the longitudinal axis, e.g., at an angle of between about 90-120 degrees to the longitudinal axis. The outer forward and rear lines may be generally parallel to forward and rear edge effect lines, respectively.

These and other aspects of the invention will be appreciated from the following description and claims.

BRIEF DESCRIPTION OF THE DRAWINGS

Illustrative embodiments that incorporate one or more features according to the invention are described with reference to the following drawings.

DETAILED DESCRIPTION

Figure 1:
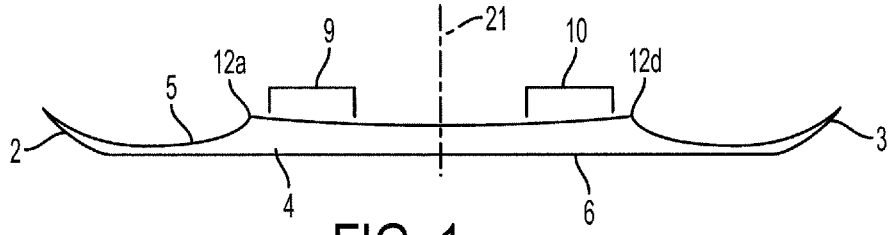
FIG. 1 shows a side view of an embodiment in which a single concave area spans across forward and rear binding mounting regions and regions of increased stiffness are located at outer ends of the mounting regions.
Figure 2:
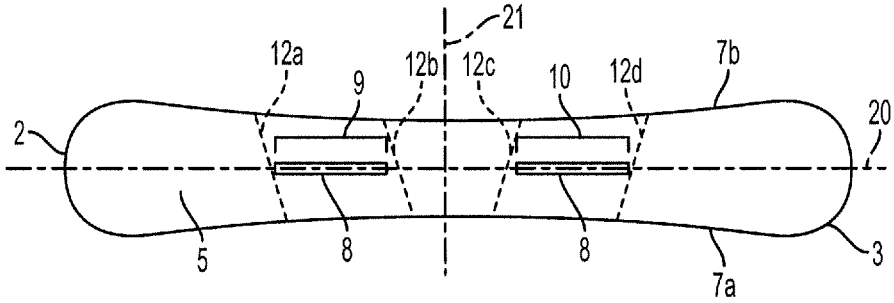
FIG. 2 shows a top view of the FIG. 1 and FIG. 4 embodiments.

FIGS. 1 and 2 show an illustrative embodiment of a board that incorporates one or more aspects of the invention. In this embodiment, the board 1 is a snowboard, but one or more aspects of the invention can be employed with boards of other types, such as skateboards, wakeboards, etc. The board 1 includes an upturned nose 2 at a forward end of the board, and a tail 3 at a rear end of the board. The tail 3 in this embodiment is upturned similarly to the nose 2, but it should be understood that the tail 3 need not necessarily turn upwardly to the same extent as the nose 2 and may be substantially straight. The nose 2 and tail 3 are located at opposite ends of a running length 4 of the board, which is generally located between transitions to the nose 2 and tail 3, as is understood in the art. The board 1 has a top surface 5 extending from the nose 2 to the tail 3 over a top portion of the running length 4, and a bottom surface 6 extending from the nose 2 to the tail 3 over a lower portion of the running length 4. The top surface 5 may be arranged in any suitable way, e.g., as a top sheet or laminate of sheets including a polymer film with suitable graphics and so on. The bottom surface 6 may be constructed and arranged to contact a gliding surface during riding, e.g., may include a sheet of polymer material such as a high density polyethylene or other material suitable for gliding on a snow, ice or other similar surface.

Side edges 7 on opposite sides of the running length 4 extend between the nose 2 and the tail 3, and may have any suitable sidecut. For example, the sidecut may be arranged to have a single, relatively large radius of curvature, or may include two or more sections that have different radii of curvature and/or are that are straight. If straight sections are included in the sidecut, the straight sections may be parallel to a longitudinal axis 20 and/or arranged at transverse angles to the longitudinal axis 20. Although in this example the sidecut is shown to cause the board to be generally narrower near the center of the running length 4 (or waist near the longitudinal center of the board at line 21) than at the transitions to the nose 2 and tail 3, other arrangements are possible, such as having the width of the board at the waist being larger than the width at one or more transitions to the nose or tail. Alternately, the sidecut may be arranged generally as shown in FIG. 1, but have a bulge near the waist such that the board width increases at the waist (and the sidecut is convex rather than concave at the bulge), but remains smaller than the width at the transitions from the running length 4 to the nose 2 and tail 3. The side edges 7 may include metal edges, e.g., at the lower portion of the edges near the bottom surface 6, that are arranged to engage with snow or ice and help maintain the board's position while turning on such surfaces.

Figure 3:
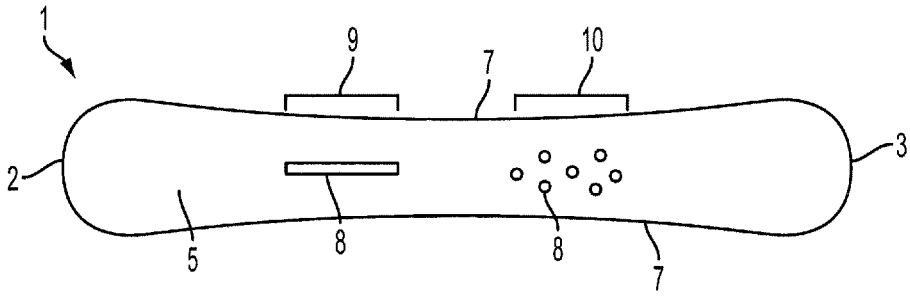
FIG. 3 shows a board with binding mounting feature options.

The board 1 may also include forward and rear binding mounting features 8 that are each arranged to engage with and secure a foot binding (not shown) to the board top surface 5, as is known in the snowboard art. The binding mounting features 8 may be arranged in any suitable way, such as in the form of a channel shown at the forward binding mounting region 9 in FIG. 3, or a pattern of threaded inserts shown at the rear binding mounting region 10 in FIG. 3. If arranged as a pattern of threaded inserts, any suitable pattern may be used, such as the Burton 3D pattern, a 4×4 pattern or others. Channel-type binding mounting arrangements and threaded insert patterns are known, for example, on snowboards currently sold by The Burton Corporation, and thus no further description is provided herein. However, the binding mounting features 8 are not limited to channel or insert arrangements as other binding mounting features are known in the art. In short, any suitable arrangement for mounting a snowboard foot binding (whether tray-type, step-in or other) may be used.

The forward and rear binding mounting features 8 each define a respective forward and rear binding mounting region 9, 10 in the running length 4 in which a respective foot binding is securable to the board. In this embodiment, each of the binding mounting features 8 provide a range of possible mounting positions for the binding, e.g., spanning over approximately 250-300 millimeters along the longitudinal axis 20 of the board. That is, by using the binding mounting features 8, a binding may be mounted at one of a plurality of different, longitudinal positions on the board. (A longitudinal axis 20 of the board extends generally from the nose 2 to the tail 3 near an approximate center of the board 1 as viewed from the top in FIG. 2). However, the binding mounting features 8 may provide a single mounting position for the binding within a region 9, 10, or an infinite number (as in the case of some channel-type mounting arrangements). Also, although the binding mounting features 8 are shown in FIG. 2 as being physically separated by a relatively large distance, the mounting features 8 may be located close together near inner ends of the mounting regions 9, 10, and may in some embodiments essentially blend together so that the mounting regions 9, 10 are immediately adjacent each other.

In this illustrative embodiment, the board 1 has a greater stiffness (with respect to bending of the board about an axis that is transverse to a longitudinal axis 20 of the board and/or that is approximately parallel to a plane of the top surface 5 of the board) in at least one portion between the forward binding mounting region 9 and the nose 2, and/or at least one portion between the rear binding mounting region 10 and the tail 3, than at least one portion of the board within a nearest binding mounting region. For example, in this embodiment, the board 1 has a greatest thickness in a portion of the running length adjacent the forward end of the binding mounting region 9 than in at least one portion of the running length within the binding mounting region 9. As a result, the board 1 in this embodiment has a higher stiffness, and a larger resistance to bending, in an area forward of the forward binding mounting region 9 than an area within the binding mounting region 9. With this arrangement, if a rider loads a forward end of the board, as in the case of an ollie or nose press, the board is more likely to bend (or will bend more and/or in a smaller radius of curvature) in an area under the rider's front foot than in an area adjacent forward end of the binding mounting region 9. It is this feature that the inventors have unexpectedly found provides significant advantages when performing various tricks and maneuvers on a board.

The embodiment of FIGS. 1 and 2 also includes a portion of greatest thickness (and in this case, higher stiffness) between the rear binding mounting region 10 and the tail 3 as compared to at least one portion of the board within the rear binding mounting region 10. It should be understood that aspects of the invention regarding stiffness and/or thickness of the board in areas outside of a corresponding binding mounting region may be used only at a forward end of the board, or only at a rear end of the board, or together, if desired.

An aspect of the invention incorporated into the embodiment of FIGS. 1 and 2 is that the regions of higher stiffness forward of the forward binding mounting region 9 and rearward of the rear binding mounting region 10 are respectively arranged along an outer forward line 12*a* and an outer rear line 12*d* that are transverse to the longitudinal axis 20. While the outer forward and rear lines 12*a* and 12*d* may be arranged at any suitable angle relative to the longitudinal axis 20, in this embodiment, the outer forward and rear lines 12*a* and 12*d* are arranged at an angle of between about 90-120 degrees with respect to the longitudinal axis 20, e.g., at an angle of about 100-110, or more specifically, 105 degrees. (The angle at which the outer forward and rear lines 12*a* and 12*d* are arranged relative to the longitudinal axis 20 is the greatest angle formed between each line 12*a* or 12*d* and the axis 20.) Also, the outer forward and rear lines 12*a* and 12*d* are arranged so that the heel side ends of the lines 12*a*, 12*d* nearest the heel side edge 7*a* of the board are closer to the longitudinal center 21 of the board than the toe side ends of the lines 12*a*, 12*d* nearest the toe side edge 7*b*. This arrangement is useful to orient the lines 12*a*, 12*d* so they are approximately parallel to a rider's front and rear foot, respectively, when mounted to the board. That is, the typical rider mounts a front foot at the forward binding mounting region 9 so that the foot is approximately at an angle of between about 90-120 to the longitudinal axis 20 with the toe nearer the nose 2 than the heel, such as about 100-110 degrees, or more specifically, 105 degrees. Similarly, the rear foot is mounted at the rear binding mounting region 10 so that the foot is approximately at an angle of between about 90-120 to the longitudinal axis 20 with the toe nearer the tail 3 than the heel, such as about 100-110 degrees, or more specifically, about 105 degrees. As a result, the outer forward line 12*a* of the region of greater stiffness is approximately parallel to the rider's front foot, and the outer rear line 12*d* of the region of greater stiffness is approximately parallel to the rider's rear foot during use. This arrangement has been found to provide a good feel to the rider when transferring weight to the board to bend the board, e.g., as in a nose press. Because the region of greater stiffness is generally parallel to the foot, the foot can sense a generally uniform transfer of force along the lateral side of the foot, as opposed to, for example, sensing that a heel side of the board resists bending more than the toe side as a result of the line 12*a*, 12*d* being transverse to the foot.

While FIG. 1 shows that the thickness of the board 1 decreases inwardly from the lines 12*a*, 12*d* toward the longitudinal center 21, any suitable arrangement of board thickness variation may be used, such as a decrease in thickness from the line 12*a* into the forward binding mounting region 9, a constant thickness from a point in the forward binding mounting region 9 into the rear binding mounting region 10, and an increase in thickness from a point in the rear binding mounting region 10 to the line 12*d*. In another arrangement, the board thickness may constantly decrease inwardly from lines 12*a*, 12*d* and then remain constant through both binding mounting regions 9, 10 and any portion between the regions 9, 10.

Figure 4:
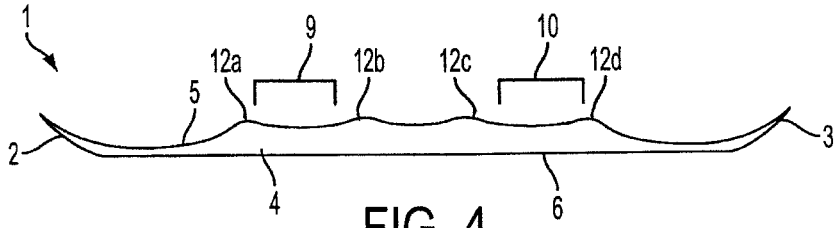
FIG. 4 shows a side view of an embodiment of a board having concave areas located in the top surface at binding mounting regions and a concave portion between the binding mounting regions.

Another aspect of the invention shown in the illustrative embodiment of FIGS. 2 and 4 is that the board has a stiffness and/or thickness that is greater in portions of the board adjacent inner ends of the forward and rear mounting regions than within the forward and/or rear mounting regions. In this embodiment, the board also has inner forward and rear regions of increased stiffness at inner ends of the forward and rear binding mounting regions 9, 10. This arrangement may help focus energy to an area under the rider's front or rear foot, causing the board to bend to a greater extent, and/or more sharply in the binding mounting region. The inner forward and rear regions of increased stiffness may be arranged along inner forward and rear lines 12*b* and 12*c* that are arranged to be transverse to the longitudinal axis 20. In some embodiments, the inner forward line 12*a* may be approximately parallel to the outer forward line 12*a*, and the inner rear line 12*c* may be approximately parallel to the outer rear line 12*d*. In this way, the outer and inner forward lines 12*a* and 12*b* may be approximately parallel to a rider's front foot when mounted to the front mounting region 9, and the outer and inner rear lines 12*d* and 12*c* may be approximately parallel to a rider's rear foot when mounted to the rear mounting region 10.

Another aspect of the invention illustrated in FIG. 4 is that the top surface 5 may include a pair of concave portions that are respectively located at a binding mounting region. For example, FIG. 4 shows that the forward binding mounting region 9 includes a concave portion where a binding is mounted, and the rear binding mounting region 10 includes a similarly arranged concave portion. Such an arrangement may help provide the board with desired bending characteristics such as those described above, e.g., by causing the board to be thinner in areas under each foot binding as compared to areas at lateral and medial sides of the binding.

Another aspect of the invention illustrated in FIG. 1 is that the board includes a concave portion that extends between the forward and rear binding mounting regions. The concave portion need not have a curved shape throughout, but instead may be formed by straight segments of the top surface 5, such as sloped segments near outer ends of the binding mounting regions 9, 10 and a straight, horizontal segment that extends from within the front mounting region 9 to within the rear mounting region 10. Although not required, this concave portion may help improve the flexibility of the board between the rider's feet, helping the board to feel less stiff, and more responsive to torsional and other bending inputs by the rider's feet.

In another aspect of the invention, a top surface of the board may include three or four concave portions. For example, two of the concave portions may be located at respective binding mounting regions 9, 10, one of the concave portions may be located between the nose 2 and the forward binding mounting region 9, and one of the concave portions may be located between the tail 3 and the rear binding mounting region 10. In another embodiment, an additional concave portion may be located between the binding mounting regions 9 and 10 as shown in FIG. 4. Alternately, the board may include three concave portions—one spanning the binding mounting regions 9, 10, one located between the nose 2 and the forward binding mounting region 9, and one located between the tail 3 and the rear binding mounting region 10, as shown in FIG. 1. These aspects of the invention may help provide the board 1 with desired bending characteristics, such as those discussed above.

In the above embodiments, the thickness and stiffness variations of the board 1 are mainly achieved by varying the thickness of the core of the board 1, which in this case is made with a sidewall construction. In one embodiment, the thickness of the board's core at the thinnest area of each binding mounting region 9, 10 is approximately 6.0 mm, while the thickness of the board's core at the thickest area near the outer ends of the binding mounting region 9, 10 (at the outer forward and rear regions of increased thickness at lines 12*a*, 12*d*) is approximately 8.0 mm. The thickness of the core at the thin area between the binding mounting regions 9, 10 may be approximately 6.0 mm. The core may be made in a typical fashion, e.g., using strips of laminated wood, such as alder, balsa, and/or others. This core may then be laminated with top and bottom reinforcement layers, top and bottom sheets, polymer sidewall elements, metal edges, and other components commonly used in the manufacture of snowboards. Regarding the type of binding mounting features used, a channel-type binding mount has been found to enable the use of a thinner core, e.g., down to about 5.0 mm, than may be possible with the use of threaded inserts (which may require a core thickness of about 6.0 mm).

Figure 5:
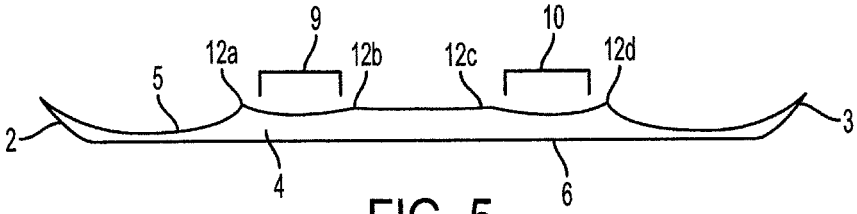
FIG. 5 shows a side view of another embodiment in which concave areas at the binding mounting regions have a substantially flat portion between the concave areas.

The board arrangement of FIGS. 1, 2 and 4 are only two possible embodiments, and others may be used to achieve the same or similar board properties. For example, FIG. 5 shows an embodiment that incorporates one or more aspects of the invention. In this embodiment, the board is arranged similar to that in FIGS. 2 and 4, except that the portion of the board 1 between the forward and rear binding mounting regions 9, 10 is generally flat such that the board has an approximately constant thickness between the inner ends of the binding mounting regions 9, 10. Thus, the forward and rear binding mounting regions 9, 10 may each have concave sections and a generally flat or constant thickness section may extend between the forward and rear binding mounting regions 9, 10.

Figure 6:
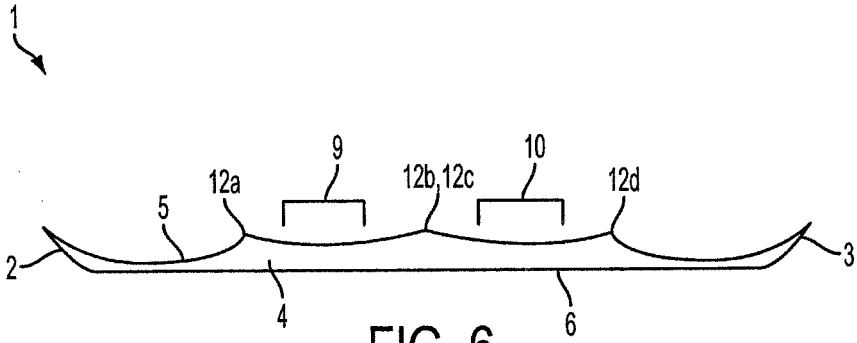
FIG. 6 shows a side view of another embodiment in which concave areas at the binding mounting regions have a convex portion between the concave areas.

FIG. 6 shows another illustrative embodiment of a board 1 that is similar to that in FIGS. 2 and 5, but has a single convex area between the forward and rear binding mounting regions 9, 10. The board 1 in FIG. 6 may help to localize bending in areas within the forward and/or rear binding mounting regions 9, 10 as opposed to areas between the forward and rear binding mounting regions 9, 10.

Figure 7:
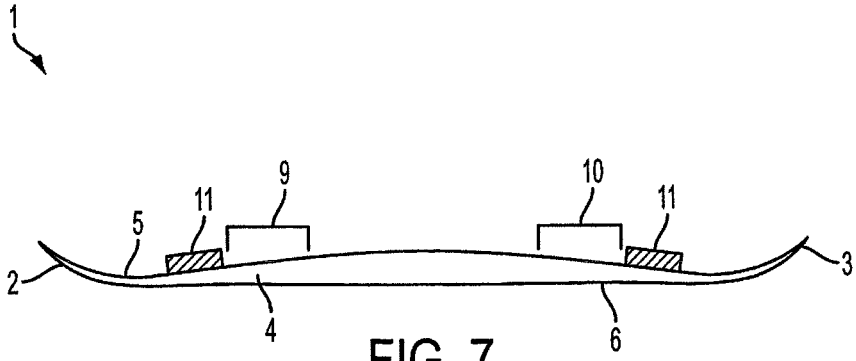
FIG. 7 shows another embodiment in which portions of the board between the forward mounting region and the nose, and between the rear mounting region and the tail are made stiff by a stiffening element.

Although in the above embodiments the stiffness variations of the board are achieved by varying the core thickness or otherwise varying the thickness of the board 1, stiffness features of the board may be provided using other techniques. For example, as shown in FIG. 7, the board 1 has a thickness profile commonly found in snowboards (e.g., a thickness of the board under the binding mounting regions 9, 10 is larger than at areas of the board forward and rearward of the mounting regions 9, 10), but includes stiffening elements 11 arranged forward and rearward of the mounting regions 9, 10. The stiffening elements 11 may function in much the same way as the thickness variations in the FIGS. 1-6 embodiments, and may be provided in any suitable way. For example, the stiffening elements 11 may be rods, beams, bars, plates or other elements that are attached to the top surface 5 of the board 1 to generally stiffen the board 1 in these areas. Alternately, the stiffening elements 11 may be incorporated into the board 1, such as by being embedded into the core and/or one or more reinforcement layers of the board 1. For example, if the core is otherwise made of laminated strips of balsa wood, one or more strips of balsa may be replaced with a material that tends to stiffen the board, e.g., a harder wood, metal, fiberglass elements, etc. In another embodiment, the stiffening elements 11 may take the form of physical features molded into or otherwise provided for the board 1. In one example, the stiffening elements 11 may include corrugations or other features that are molded into or otherwise formed into the top surface 5 of the board so as to increase the moment of inertia of the board in desired portions. Other arrangements will occur to those of skill in the art, such as the use of different materials in the reinforcement layer(s) (e.g., a carbon fiber material in sections to be stiffened, whereas a lower tensile strength material is used in other portions), different resin materials, different base materials, and so on.

Although the embodiments above show the board 1 having no camber, or a flat camber, at the bottom surface 6, other camber arrangements may be used. For example, the board 1 may have a standard camber such that, with the board unweighted, the center portion of the bottom surface 6 is uplifted from an underlying flat surface with only portions of the board 1 near the transitions to the nose and tail being in contact with the underlying surface. In another embodiment, the board 1 may have a reverse camber, or rockered, arrangement such that the bottom surface 6 of the board 1 generally bows downwardly, or is convex, along the running length 4. In another embodiment, the board may have a dual camber arrangement, e.g., such that areas generally at the forward and rear binding mounting regions 9, 10 may have individual cambered sections. Other camber arrangements are possible.

Figure 8:
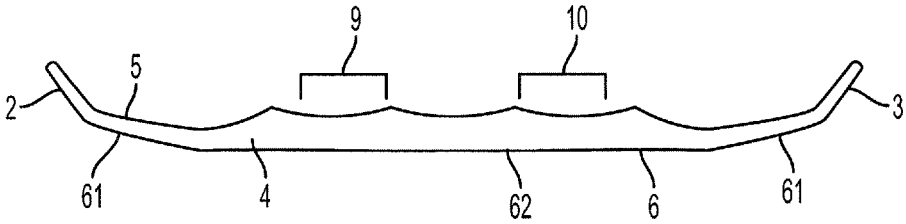
FIG. 8 shows an embodiment like that of FIG. 4 in which ends of the board are upturned.

For example, FIG. 8 shows another camber arrangement for a board that incorporates one or more aspects of the invention. In this embodiment, a forward portion 61 of the bottom surface 6 between the nose 2 and the forward binding mounting region 9 is arranged at an angle relative to a portion of the bottom surface 6 near the forward binding mounting region 9. Similarly, a rear portion 61 of the bottom surface 6 between the tail 3 and the rear binding mounting region 10 is arranged at an angle relative to a portion of the bottom surface 6 near the rear binding mounting region 10. The center portion 62 of the bottom surface 6 in this embodiment has no camber, or a flat camber, but may have a reverse camber (or rocker) shape such that the center portion 62 bows downwardly, or may have a standard camber arrangement, or may have a dual camber arrangement.

Figure 9:
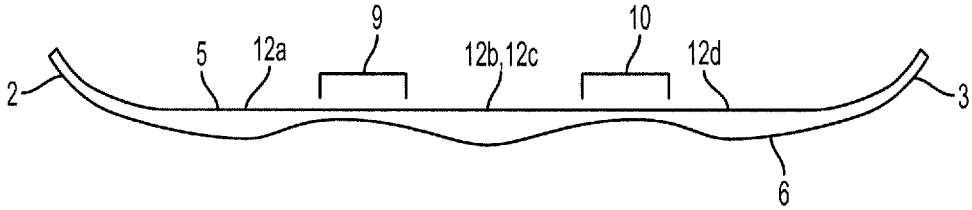
FIG. 9 shows an embodiment in which the bottom surface of the board includes concave portions under the binding mounting regions.

Although several of the embodiments described above provide for varying board thickness by varying the shape at a top side of the board, other techniques are possible, such as varying the shape of the board at the bottom in addition, or instead of, the top surface. FIG. 9 shows another illustrative embodiment that incorporates one or more aspects of the invention and has a shaped bottom surface to provide desired board bending characteristics. In this embodiment, stiffness and/or thickness variations are provided along the board's length similar to that of FIG. 6, but in this case, the top surface 5 of the board 1 is generally flat while the bottom surface 6 has concave portions located under the forward and rear binding mounting regions 9 and 10. Thus, the board 1 has a thickness, and in this example, a stiffness, that is greater in a portion forward of the forward binding mounting region 9 (e.g., along a line 12*a*) than in at least one portion of the running length within the binding mounting region 9. Similarly, the board 1 has a thickness, and a stiffness, that is greater in a portion rearward of the rear binding mounting region 10 (e.g., along a line 12*d*) than in at least one portion of the running length within the binding mounting region 10. Thus, the board 1 in this embodiment may share the same, or similar bending characteristics of that of the FIGS. 1-8 embodiments. The board 1 in the FIG. 9 embodiment also employs the aspect of the invention where the board has a stiffness and/or thickness that is greater in portions of the board adjacent opposite ends of the forward and/or rear mounting region than near a center of the forward and/or rear mounting region, and the aspect that a concave portion of the bottom surface 6 is located under respective binding mounting regions 9 and 10 while a top surface 5 of the board is generally flat or has a different shape than the underlying bottom surface 6.

The FIG. 9 embodiment may be modified in various ways, similar to those mentioned above. For example, the bottom surface 6 (or top surface 5) may have a concave portion between the binding mounting regions 9 and 10 similar to the top surface 5 in FIG. 1. This arrangement may help improve the "feel" of the board between the rider's feet, e.g., make the board more flexible and responsive to rider input. Alternately, or in addition, the board 1 may incorporate various camber arrangements, such as a standard camber, or arrangements like those described in connection with FIG. 8 above. For example, the FIG. 9 board may have forward and/or rearward portions 61 of the bottom surface 6 that are arranged at an angle with respect to the approximate, or average, plane of the center portion 62 of the bottom surface 6 under the binding mounting regions 9, 10. The board 1 may also have an overall rocker shape while maintaining the concave sections in the bottom surface 6. Such an arrangement may give the board a dual camber arrangement with a rocker component.

In another aspect of the invention, a board may be provided with various bending characteristics such as those described above by way of interaction of the board with one or more bindings attached to the board at the binding mounting regions. For example, a binding may include wings, rods or other components on a lateral side of the binding that can help reinforce and stiffen the board in areas forward or rearward of a respective binding mounting region. In another embodiment, a stiffening element 11 may be attached to the board along with, or separate from a binding. The stiffening element 11 may be secured to the board 1 using the mounting features 8 or other attachment arrangements, such as screws, adhesive, or other.

Figure 10:
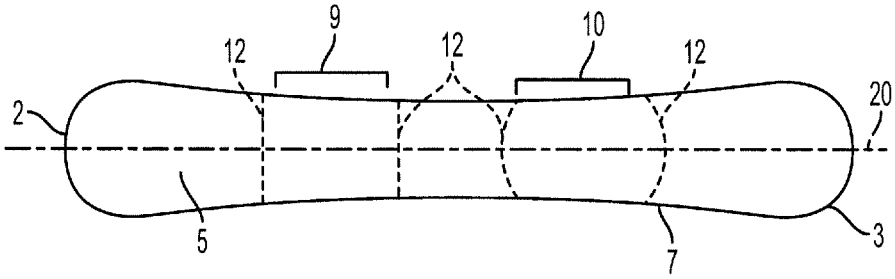
FIG. 10 shows a top view of an embodiment in which areas of relatively high stiffness are arranged linearly and perpendicular to the board's longitudinal axis and are arranged along curved lines.
Figure 11:
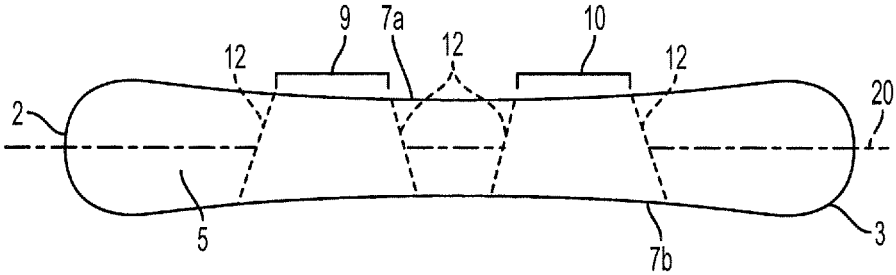
FIG. 11 shows a top view of another embodiment in which areas of relatively high stiffness are arranged at angles transverse to the board's longitudinal axis.

In the embodiments above, the stiffness and/or thickness of the board in the increased stiffness portions extend in lateral directions across the width of the board 1 in a way that generally aligns with a rider's adjacent foot, but other arrangements are possible, whether approximately symmetrical or asymmetrical with respect to the longitudinal axis 20 of the board. For example, FIG. 10 shows a top view of an embodiment (similar to that of FIG. 2), except that in this embodiment the lines 12 at the locations of the regions of increased stiffness of the board are arranged in different ways. For example, the lines 12 near the forward binding mounting region 9 are generally perpendicular to the longitudinal axis 20, whereas the lines 12 near, the rear binding mounting region 10 are curved such that a concave side of the curved lines 12 faces the rear binding mounting region 10. Again, these are just two examples, and the thickness and/or stiffness profiles may be arranged in other ways. For example, the portions with greatest thickness and/or stiffness may be arranged to be generally perpendicular to the longitudinal axis 20 at all locations fore and aft of the binding mounting regions, the portions with greatest thickness and/or stiffness may all be curved in a way similar to that shown relative to the rear binding mounting region 10 in FIG. 9, and so on. In another illustrative embodiment, FIG. 11 shows an asymmetrical arrangement in which the lines 12 (portions with greatest thickness and/or stiffness) are arranged at a non-perpendicular angle to the longitudinal axis 20. For example, the arrangement of FIG. 11 may be useful for a "goofy" style rider (i.e. a rider that typically rides with the left foot toward the rear) if the board 1 is "directional" (i.e., has a shape such that the board is intended to be ridden nose 2 first, as is the case with alpine-type snowboards, some powder-type boards, boards that have a wider nose than tail, and others). However, if the board 1 in FIG. 11 is not "directional" or is intended to be ridden with either the nose or tail forward, then the board 1 may be suitable for regular or goofy-type riders. In such a case, the rider may mount bindings on the board with the heel nearest the heel edge 7*a* as shown in FIG. 11.

Of course, other arrangements for the thickness and/or stiffness other than those in FIGS. 10 and 11 are possible. For example, the lines 12 need not be straight, and may be curved in any suitable way, have multiple linear segments or other arrangements. In one embodiment, the lines 12 at forward and rear ends of the forward and rear binding mounting regions 9, 10 may be curved so that a center portion of the lines at the longitudinal axis is nearer the nose 2 or tail 3 than ends of the lines 12 near the side edges 7. Also, although the embodiments above have a single thickest and/or stiffest portion forward and/or rearward of the binding mounting regions 9, 10, two or more portions of equal thickness and/or stiffness may be located forward and/or rearward of the binding mounting regions 9, 10, if desired. The lines 12 for such multiple portions may be arranged to be parallel, or equidistant along their length across the width of the board, or may have other arrangements relative to each other. Further, although lines 12 are shown to indicate areas of relatively greater thickness and/or stiffness, such areas may span over a wider area than that shown, e.g., 1 cm, 3 cm, 5 cm or more.

The relative stiffness of portions of the board may be defined in different ways. For example, a portion of the board may be said to be more stiff than another if that portion of the board has a higher moment of inertia than the other board portion. Alternately, a portion of the board may be said to be more stiff than another if that portion exhibits a higher resistance to bending under actual test conditions than another portion. In another embodiment, a board may be uniformly loaded along its length and a first portion of the board that tend to bend in a curve with a larger radius of curvature or along a longer arc length than another second portion may be said to be more stiff than the second portion. In another testing environment, different portions of the board may be tested in isolation and a resistance to a bending force measured. For example, an amount of deflection of one portion of a board in response to a particular load or loading arrangement may be compared to a deflection of another portion of the board in response to the same load or loading arrangement. The portion having a smaller deflection may be said to be more stiff than the other portion.

Using any one of these analyses, a percentage difference in stiffness between two portions of a board may be defined. For example, if a deflection analysis is used as described above, the difference in deflection amounts may be divided by the deflection amount for the less stiff portion to determine a percentage difference in stiffness. A similar calculation may be made using differences in moment of inertia, radii of curvature or other values to define a percentage difference in stiffness between two board portions.

In one aspect of the invention, a percentage difference in stiffness between at least one portion of the board between the forward binding mounting region and the nose, or at least one portion between the rear binding mounting region and the tail, and at least one portion of the board within a nearest binding mounting region may be 10%, 20%, 30% or more.

Figure 12A:
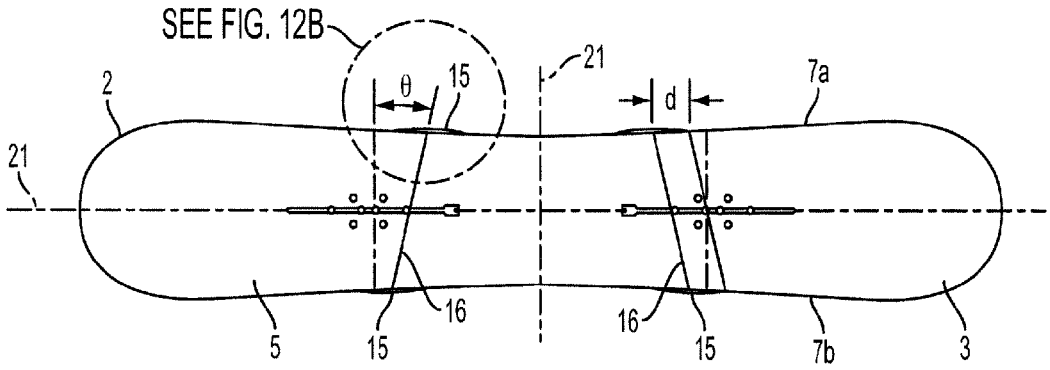
FIG. 12 shows an illustrative embodiment of a board including side edge convex portions.
Figure 12B:
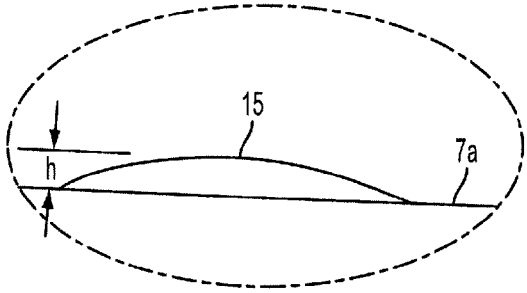

FIG. 12 shows another board that incorporates aspects of the invention regarding the use of convex portions at the heel and toe side edges of the board. Such features have been found useful in aiding edge grip, e.g., when turning on a hard surface. In accordance with an aspect of the invention, the side edge convex portions may be arranged so that heel side convex portions are closer to a board longitudinal centerline than toe side convex portions. This arrangement may help arrange the heel and toe side convex portions to be near a rider's adjacent foot when mounted to the board at a standard stance angle. The convex portions may also be located on the board toward an inner side of the corresponding binding mounting region, e.g., so that the convex portions tend to be located on a medial side of the rider's feet when mounted to the board. This location has been found particularly useful in assisting board response and edge grip during turning.

In the illustrative embodiment of FIG. 12, two convex portions 15 are provided on the heel side 7*a* of the board 1, and two convex portions 15 are provided on the toe side 7*b*. The heel side convex portions 15 are located nearer the longitudinal center 21 of the board than the toe side convex portions 15, or said another way, the toe side convex portions 15 are closer to the nose/tail than the heel side convex portions 15. Edge effect lines 16 that extend between the forward convex portions 15 and the rear convex portions, respectively, are transverse to the longitudinal axis 20 of the board, and may be at an angle of between about 90-120 degrees to the longitudinal axis 20, e.g., an angle of about 100-110 degrees, or about 102 degrees to the longitudinal axis 20 or an angle θ relative to a reference stance line 17 of about 12 degrees. Thus, the edge effect lines 16 may be approximately parallel to a heel-toe line of an adjacent rider's foot that is mounted at a typical stance angle. An angle of about 102 degrees to the longitudinal axis or an angle θ of about 12 degrees for the edge effect lines may be coupled with outer forward and rear lines 12*a* and 12*d* of increased stiffness arranged at an angle of about 105 degrees to the longitudinal axis. The three degree difference between the edge effect lines 16 and the nearest lines 12, 12*d* may be used to accommodate the curve of a rider's foot or boot. That is, a line extending along the lateral side of a rider's foot will generally be arranged at an angle of about three degrees to a line that extends between the rider's heel and toe due to the curvature of the foot. By having the outer lines 12*a*, 12*d* arranged at an about three degree angle to the nearest edge effect line 16, the region of increased stiffness may be made generally parallel to the rider's lateral side of the foot, while the heel and toe side convex portions 15 are located at approximately equivalent distances from the rider's heel and toe, e.g., offset from the heel and toe toward the longitudinal center of the board by an equal distance.

As suggested above, the edge effect lines 16 may be offset inwardly toward the longitudinal center 21 of the board from the reference stance lines 17 by a distance d about 55 mm, although smaller or greater distances may be used. As a result, the edge effect lines 16 may be located at an inner end of the respective binding mounting regions 9, 10 and may be located inwardly relative to an adjacent rider's foot mounted to the board. (The reference stance lines 17 are perpendicular to the longitudinal axis 20 and are locations in the forward and rear binding mounting regions 9, 10 where an average rider positions a center of the foot when mounted to the board. A distance between the reference stance lines 17 may range from about 450 mm to about 550 mm, and the reference stance lines 17 may be equidistant from the longitudinal center 21.)

As can be seen in FIG. 12, the convex portions 15 may extend to a maximum height h away from the local side edge 7 of about 0.5 to about 2.5 mm. That is, while the side edge 7 may have an overall sidecut curve or other shape, the convex portions 15 extend outwardly away from the longitudinal axis 20 so as to form convex "bumps" or features on the side edge 7. Also, the convex portions 15 may have an overall length along the side edge 7 of about 50-100 mm, although other lengths or maximum heights h may be used.

Figure 13:
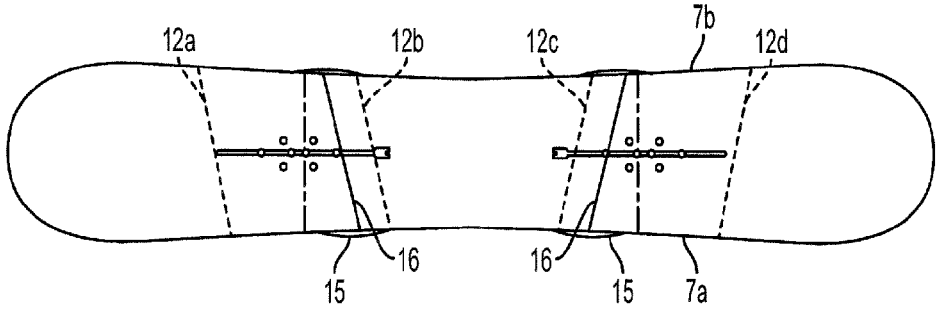
FIG. 13 shows an embodiment of a board including side edge convex portions and regions of increased stiffness arranged like that in FIG. 4.

Various aspects of the invention may be used alone or in combination with other aspects of the invention, as suitable. For example, FIG. 13 shows an illustrative embodiment that includes both side edge convex portions 15 like that in FIG. 12 and regions of increased stiffness arranged along lines 12 like that of FIGS. 2 and 4. This combination of features have been found particularly effective in providing excellent board turning performance along with an enhanced ability to store and release energy when performing maneuvers such as ollies and nose presses. Of course, it will be understood that other increased stiffness arrangements for a board, such as that shown in figures other than FIG. 4, may be combined with the side edge convex portions described in connection with FIG. 12.

Having thus described several aspects of the invention, it is to be appreciated various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

The invention claimed is:

1. A gliding board comprising:

an upturned nose at a forward end of the board;

a tail at a rear end of the board;

a running length connected to and located between the nose and tail;

a top surface of the board extending from the nose to the tail over a top portion of the running length;

a bottom surface of the board extending from the nose to the tail over a lower portion of the running length, at least a portion of the bottom surface being constructed and arranged to contact a gliding surface during riding;

side edges on opposite sides of the running length and extending between the nose and the tail; and forward and rear binding mounting features each arranged to engage with and secure a foot binding to the board top surface, the forward and rear binding mounting features each defining a respective forward and rear binding mounting region in the running length in which a respective foot binding is securable to the board, the forward binding mounting region being located nearer the nose than the rear binding mounting region, the forward binding mounting region having a forward end nearest the nose and the rear binding mounting region having a rear end nearest the tail;

wherein the board has outer forward and rear regions of greater stiffness with respect to bending of the board about an axis that is transverse to a longitudinal axis of the board in a portion between the forward binding mounting region and the nose and in a portion between the rear binding mounting region and the tail, respectively, where the regions of greater stiffness have a stiffness with respect to bending that is greater than any portion of the board in the binding mounting regions, and wherein the outer forward and rear regions of greater stiffness are arranged respectively along outer forward and rear lines that are transverse to the longitudinal axis; and wherein the board has inner forward and rear regions of increased stiffness with respect to bending of the board about the axis that is transverse to the longitudinal axis arranged along inner forward and rear lines between the binding mounting regions, the inner forward region of increased stiffness being located nearer the forward binding mounting region than the inner rear region of increased stiffness, and the inner rear region of increased stiffness being located nearer the rear binding mounting region than the inner forward region of increased stiffness, the inner forward and rear regions of increased stiffness having a greater stiffness with respect to bending than portions of the board within the binding mounting regions.

2. The board of claim 1, wherein the outer forward and rear lines are at an angle of between about 90-120 degrees to the longitudinal axis.

3. The board of claim 1, wherein toe side ends of the outer forward and rear lines are located farther from a longitudinal center of the board than heel side ends of the outer forward and rear lines.

4. The board of claim 1, wherein the inner forward line is parallel to the outer forward line, and the inner rear line is parallel to the outer rear line.

5. The board of claim 4, wherein the outer and inner forward lines are at an angle of between about 90-120 degrees to the longitudinal axis, and the outer and inner rear lines are at an angle of between about 90-120 degrees to the longitudinal axis.

6. The board of claim 5, wherein the outer and inner forward lines are arranged at a different angle relative to the longitudinal axis than to the outer and inner rear lines.

7. The board of claim 5, wherein toe side ends of the outer and inner forward and rear lines are located farther from a longitudinal center of the board than heel side ends of the outer and inner forward and rear lines.

8. The board of claim 1, wherein the inner forward and rear regions of increased stiffness have a lower resistance to bending than the outer forward and rear regions of greater stiffness.

9. The board of claim 1, wherein the outer forward and rear regions of greater stiffness are formed by thickness variations in a core of the board.

10. The board of claim 1, wherein the side edges include a heel side edge and a toe side edge, the heel side edge including forward and rear heel convex portions respectively located near an intended location for a rider's forward and rear heel, and the toe side edge including forward and rear toe convex portions respectively located near an intended location for a rider's forward and rear toe.

11. The board of claim 10, wherein the heel convex portions are located closer to a longitudinal center of the board than the toe convex portions.

12. The board of claim 10, wherein a forward edge effect line extending between the forward heel convex portion and the forward toe convex portion is transverse to the longitudinal axis, and a rear edge effect line extending between the rear heel convex portion and the rear toe convex portion is transverse to the longitudinal axis.

13. The board of claim 12, wherein the forward and rear edge effect lines are arranged at an angle of between about 90-120 degrees to the longitudinal axis.

14. The board of claim 12, wherein the forward edge effect line is located near an inner end of the forward mounting region, and the rear edge effect line is located near an inner end of the rear mounting region.

15. The board of claim 10, wherein the heel and toe convex portions each have a peak height relative to an adjacent portion of the side edge of about 0.5 to 2.5 mm.

16. The board of claim 1, wherein each binding mounting feature includes a plurality of threaded inserts fixed to the running length, or includes a channel fixed to the running length.

17. The board of claim 1, wherein the forward and rear binding mounting features are separated from each other.

18. The board of claim 1, wherein the board has a thickness that is greater in the outer forward and rear regions of greater stiffness than in any other portion of the board.

19. The board of claim 1, wherein the side edges include metal edges arranged to engage the gliding surface during riding.

20. The board of claim 1, wherein the side edges have a sidecut.

21. The board of claim 1, wherein the nose, tail and running length of the board have a sidewall construction, and wherein the side edges include a sidewall member at partially between the top surface and the bottom surface.

22. The board of claim 1, wherein the nose, tail and running length of the board have a cap construction.

23. The board of claim 1, wherein forward and rear concave portions are located in the board top surface at respective forward and rear binding mounting regions, one concave portion is located between the nose and the forward binding mounting region, and one concave portion is located between the tail and the rear binding mounting region.

24. The board of claim 23, wherein the board is a snowboard.

25. The board of claim 1, wherein the top surface includes five concave portions and four convex portions, with two of the concave portions being located at respective binding mounting regions.

26. A gliding board comprising:

an upturned nose at a forward end of the board;

a tail at a rear end of the board;

a running length connected to and located between the nose and tail;

a top surface of the board extending from the nose to the tail over a top portion of the running length;

a bottom surface of the board extending from the nose to the tail over a lower portion of the running length, at least a portion of the bottom surface being constructed and arranged to contact a gliding surface during riding;

heel side and toe side edges on opposite sides of the running length and extending between the nose and the tail, the heel side and toe side edges each having an overall sidecut that defines a concave shape; and forward and rear binding mounting features each arranged to engage with and secure a foot binding to the board top surface, the forward and rear binding mounting features each defining a respective forward and rear binding mounting region in the running length in which a respective foot binding is securable to the board, the forward binding mounting region being located nearer the nose than the rear binding mounting region, the forward binding mounting region having a forward end nearest the nose and the rear binding mounting region having a rear end nearest the tail;

wherein the heel side edge includes forward and rear heel convex portions respectively positioned near a location of a forward and rear heel of a rider's feet when secured to the board at the forward and rear binding mounting regions, and the toe side edge includes forward and rear toe convex portions respectively positioned near a location of a forward and rear toe of a rider's feet when secured to the board at the forward and rear binding mounting regions, the overall sidecut of the heel side edge and the toe side edge including no other convex portions other than the respective forward and rear heel convex portions and forward and rear toe convex portions;

wherein the forward heel convex portion is located closer to a longitudinal center of the board than the forward toe convex portion, and rear heel convex portion is located closer to a longitudinal center of the board than the rear toe convex portion.

27. The board of claim 26, wherein a forward edge effect line extending between the forward heel convex portion and the forward toe convex portion is transverse to a longitudinal axis of the board, and a rear edge effect line extending between the rear heel convex portion and the rear toe convex portion is transverse to the longitudinal axis.

28. The board of claim 27, wherein the forward and rear edge effect lines are arranged at an angle of between about 90-120 degrees to the longitudinal axis.

29. The board of claim 27, wherein the forward edge effect line is located near an inner end of the forward mounting region, and the rear edge effect line is located near an inner end of the rear mounting region.

30. The board of claim 26, wherein the heel and toe convex portions each have a peak height relative to an adjacent portion of the side edge of about 0.5 to 2.5 mm.

31. The board of claim 26, wherein the board has outer forward and rear regions of greater stiffness with respect to bending of the board about an axis that is transverse to a longitudinal axis of the board in a portion between the forward binding mounting region and the nose and in a portion between the rear binding mounting region and the tail, respectively.

32. The board of claim 31, wherein the outer forward and rear regions of greater stiffness are arranged respectively along outer forward and rear lines that are transverse to the longitudinal axis.

33. The board of claim 32, wherein the outer forward and rear lines are at an angle of between about 90-120 degrees to the longitudinal axis.

34. The board of claim 32, wherein a forward edge effect line extending between the forward heel convex portion and the forward toe convex portion is transverse to the longitudinal axis of the board, and a rear edge effect line extending between the rear heel convex portion and the rear toe convex portion is transverse to the longitudinal axis, and wherein the forward edge effect line is approximately parallel to the outer forward line, and the rear edge effect line is approximately parallel to the outer rear line.

35. The board of claim 31, wherein the board has inner forward and rear regions of increased stiffness with respect to bending of the board about the axis that is transverse to the longitudinal axis arranged along inner forward and rear lines between the binding mounting regions, the inner forward region of increased stiffness being located nearer the forward binding mounting region than the inner rear region of increased stiffness, and the inner rear region of increased stiffness being located nearer the rear binding mounting region than the inner forward region of increased stiffness, the inner forward and rear regions of increased stiffness having a greater stiffness with respect to bending than portions of the board within the binding mounting regions.

36. The board of claim 35, wherein the inner forward line is parallel to the outer forward line, and the inner rear line is parallel to the outer rear line.

37. The board of claim 26, wherein a central portion of the running length has rocker.

* * * * *